US007476076B2

(12) United States Patent
Shimada

(10) Patent No.: US 7,476,076 B2
(45) Date of Patent: Jan. 13, 2009

(54) CENTRIFUGAL FAN

(75) Inventor: Ryuichi Shimada, Kiryu (JP)

(73) Assignee: Nidec Servo Corporation, Kiryu-shi (JP)

( * ) Notice: Subject to any disclaimer, the term of this patent is extended or adjusted under 35 U.S.C. 154(b) by 327 days.

(21) Appl. No.: 11/392,749

(22) Filed: Mar. 30, 2006

(65) Prior Publication Data

US 2006/0222491 A1 Oct. 5, 2006

(30) Foreign Application Priority Data

Apr. 1, 2005 (JP) ..... 2005-105564

(51) Int. Cl.
*F04D 29/44* (2006.01)

(52) U.S. Cl. ..... 415/58.4; 415/119; 415/204

(58) Field of Classification Search ..... 415/58.2–58.4, 415/58.6, 119, 170.1, 172.1, 173.1, 173.5, 415/174.5, 204, 206
See application file for complete search history.

(56) References Cited

U.S. PATENT DOCUMENTS 1,921,218 A * 8/1933 Colby ..... 415/206
2,981,461 A * 4/1961 Murphy ..... 415/58.4
3,597,117 A * 8/1971 Zoehfeld ..... 415/206
3,627,440 A * 12/1971 Wood ..... 415/58.3
4,432,694 A * 2/1984 Kuroda et al. ..... 415/172.1
4,917,572 A * 4/1990 Van Houten ..... 415/206
5,813,831 A * 9/1998 Matsunaga et al. ..... 415/204
6,368,081 B1 * 4/2002 Matsumoto ..... 417/423.15
6,568,905 B2 * 5/2003 Horng et al. ..... 415/206
2005/0207888 A1 9/2005 Kashiwazaki et al.

FOREIGN PATENT DOCUMENTS

JP 59-28096 A * 2/1984
JP 10-2299 1/1998
JP 10-54388 2/1998
JP 10-141291 5/1998

OTHER PUBLICATIONS

U.S. Appl. No. 11/339,610, filed Jan. 26, 2006, Yoshio Kashiwazaki et al.
U.S. Appl. No. 11/339,611, filed Jan. 26, 2006, Morio Senba.

* cited by examiner

*Primary Examiner*—Christopher Verdier
(74) *Attorney, Agent, or Firm*—Oblon, Spivak, McClelland, Maier & Neustadt, P.C.

(57) ABSTRACT

A centrifugal fan includes a scroll casing having first and second flat base walls, and a circumferential side wall. An air inlet is formed on a center portion of the first base wall and an exhaust port is formed on the circumferential side wall. An airflow correction mechanism that forms smooth airflow when an impeller rotates is provided. The mechanism has an annular rib that is formed on the inside surface of the first base wall so as to be jutted to the side of the second base wall and to be concentric with the rotating shaft, and a recess portion that is formed on every blade of the impeller so that the annular rib is inserted therein with a predetermined gap. The annular rib and the recess portion are configured to change the direction of airflow directed to the air inlet back to a space between the blades.

2 Claims, 4 Drawing Sheets

CENTRIFUGAL FAN

BACKGROUND OF THE INVENTION

The present invention relates to a centrifugal fan that collects airflow taken in from an air inlet formed at the center of one flat base wall of a scroll casing and discharges the airflow from an exhaust port formed on a circumferential side wall in a centrifugal direction. More particularly, the present invention relates to a mechanism to prevent backflow during fan operating.

Centrifugal fans, which use DC brushless motors especially, are widely used to cool electronic components of OA (office automatic) equipment such as a personal computer, a copying machine, a liquid crystal projector and a disk array because they can not only make the motors compact and light in weight but also control air quantity easily due to easy control of the motor.

A prior art of such a centrifugal fan will be described with reference to FIG. 6 through FIG. 8. FIG. 6 is a sectional view in a plane parallel to a rotating shaft showing a construction of a conventional centrifugal fan, FIG. 7 is a front view of the centrifugal fan shown in FIG. 6 viewed from an air inlet, and FIG. 8 is an enlarged sectional view of the upper half of the centrifugal fan shown in FIG. 6.

The illustrated centrifugal fan 1 has a scroll casing 10, an impeller 20 that is rotatably mounted in the casing 10, and a motor 30 that rotates the impeller 20. The casing 10 is provided with first and second flat base walls that are parallel to each other and a circumferential side wall that covers the circumferences of these base walls. The casing 10 is constructed by combining a first casing 10*a* that constitutes the first base wall and a second casing 10*b* that constitutes the second base wall and the circumferential side wall.

An air inlet 11 that opens in the axial direction is formed at the center portion of the first casing 10*a* and an exhaust port 12 (see FIG. 7) that opens in the circumferential direction is formed on one portion of the circumferential side wall. As shown in FIG. 6, the inner circumference of the air inlet 11 is inside to form a bell mouth 13.

A cylindrical bearing box 15 is formed on the second casing 10*b*. The bearing box 15 supports the rotating shaft 31 via bearings 14 in its inside. A stator 32 of the motor 30 is fixed to the outside of the bearing box 15.

The motor 30 is an outer-rotor type DC brushless motor that consists of a stator 32 having a stator core 32*a* and coils 32*b* wound in slots of the stator core 32*a*, and a rotor 33 having a cup-shaped hub 33*a* fixed on the tip of the rotating shaft 31 and a permanent magnet 33*b* attached to the inner circumferential surface of the hub 33*a*.

The impeller 20 is fitted to the outer circumference of the hub 33*a* of the rotor 33. A great number of blades 21 are arranged around the outer circumference of the impeller 20. During fan operating, the impeller 20 rotates in a predetermined direction, which discharges the air taken in from the air inlet 11 to the periphery of the impeller 20 as regular airflow A by the centrifugal force as shown in FIG. 6. The air is collected by the inner circumferential surface of the casing 10, and is discharged from the exhaust port 12.

In the meantime, when the above-described centrifugal fan 1 operates with low air quantity, backflow B that flows in a space between the impeller 20 and the inner surface of the first casing 10*a* and is discharged from the air inlet 11 and recycling flow C that returns back to the impeller 20 are generated. The backflow B and the recycling flow C are generated because the regular flow A in radial direction tends to be concentrated to the side of the hub 33*a* during low air quantity operation. Particularly, the recycling flow C results from a velocity difference of airflow passing through a space between the impeller 20 and the inner surface of the first casing 10*a*. That is, the airflow at the side of the impeller 20 is slower than that at the side of the first casing 10*a* as shown in FIG. 8. Such backflow B and recycling flow C deteriorate the blowing performance of the centrifugal fan 1 and increase the noise.

Publications of Japanese unexamined patent applications No. Hei10-141291 and No. Hei10-054388 disclose techniques to prevent the deterioration of the blowing performance and the generation of the noise that are caused by the backflow B and the recycling flow C described above.

Namely, the publication of Japanese unexamined patent application No. Hei10-141291 discloses a centrifugal fan in which a screen-like guide plate is mounted on an outer portion of a casing at a periphery of an air inlet in order to return airflow discharged from the air inlet back to the air inlet. Further, an annular jutted portion is formed at a tip of an impeller so as to be inserted into a recess portion of a bell mouth formed having a U-shaped section.

However, since the guide plate is mounted on the outside of the casing in the construction of the publication, the size of the centrifugal fan in the axial direction (the axial size) becomes larger. Further, since the jutted portion is formed on the impeller, the inertial mass of the impeller becomes larger, which increases load on the motor.

Further, the publication of Japanese unexamined patent application No. Hei10-054388 discloses a centrifugal fan having labyrinth seal, which consists of a cylindrical shield plate mounted on an outer tip of an impeller and a cylindrical rib formed on a housing side, in order to prevent the backflow.

However, since the fan of the publication is constructed to reduce the backflow by seal effect, a high manufacturing accuracy is required to satisfy the seal effect, which increases a manufacturing cost. Further, since the shield plate is formed on the impeller, both the axial size of the impeller and the inertial mass of the impeller become larger, which increases the axial size of the centrifugal fan and load on the motor.

SUMMARY OF THE INVENTION

The purpose of the present invention is to solve the above-mentioned problems by providing an improved centrifugal fan, which is capable of preventing deterioration of the blowing performance and generation of the noise that are caused by the backflow and the recycling flow during low air quantity operation without increasing the size in the axial direction, the size of the impeller and the inertial mass.

In order to accomplish the above-mentioned first purpose, a centrifugal fan according to the present invention includes:

a scroll casing that has first and second flat base walls, a circumferential side wall covering the circumferences of the base walls, an air inlet that is opened in an axial direction being formed on a center portion of the first base wall and an exhaust port that is opened in a circumferential direction being formed on one portion of the circumferential side wall;

a motor that is attached to a center portion of the second base wall at the inside of the casing so that a rotating shaft of the motor is perpendicular to the second base wall;

an impeller that is fixed to the rotating shaft, the impeller having many blades along the outer region thereof; and an airflow correction mechanism that forms smooth airflow when the impeller rotates, wherein the airflow correction mechanism has an annular rib that is formed on the inside surface of the first base wall so as to be jutted to the side of the second base wall and to be concentric with the rotating shaft, and a recess portion that is formed on every blade of the impeller so that the annular rib is inserted therein with a predetermined gap, the annular rib and the recess portion being configured to change the direction of airflow directed to the air inlet back to a space between the blades.

With this construction, since the insertion of the annular rib into the recess portion forms a wall in an airflow path directed to the air inlet, the airflow directed to the air inlet returns back to the space between the blades, which can prevent generation of backflow and recycling flow. This prevents deterioration of the blowing performance and generation of the noise during low air quantity operation.

Since the structure of the present invention returns airflow back to the space between the blades without using the seal effect used in the prior art, it does not require high manufacturing accuracy, which can reduce the manufacturing cost. Further, since the annular rib is formed on the housing, it does not increase the axial size of the impeller and the inertial mass thereof. Therefore, the annular rib has little effect on the axial size of the centrifugal fan and the load on the motor.

In addition, it is preferable that an outer bottom portion of the annular rib is formed to have a circular curve section so that the outer circumferential surface of the annular rib is smoothly connected to the inside surface of the first base wall. With this construction, the airflow passing through the space between the impeller and the casing is effectively redirected so as to merge with the regular flow that is taken in from the air inlet and flows in the radial direction.

Further, an inner tip portion of the annular rib is preferably formed to have a circular curve section. Although the regular airflow that is taken in from the air inlet and flows in the radial direction tends to be concentrated to the side of the second base wall during low air quantity operation, it flows not only at the side of the second base wall but also at the side of the first base wall at which the airflow correction mechanism is formed during high air quantity operation. If the inner tip of the annular rib has a rectangular section shape, the regular airflow would be interrupted. On the other hand, when the inner tip portion of the annular rib is formed to have a circular curve section as mentioned above, the regular airflow along this portion is not interrupted during high air quantity operation.

Still further, the depth of the recess portion is preferably larger than a gap formed between the inside surface of the first base wall and the impeller that are faced with each other. With this construction, enough airflow resistance can be obtained by the airflow correction mechanism that consists of the annular rib and the recess portion.

DESCRIPTION OF THE ACCOMPANYING DRAWINGS

DESCRIPTION OF THE EMBODIMENTS

Hereinafter, an embodiment of a centrifugal fan according to the present invention will be described with reference to the drawings.

Figure 1:
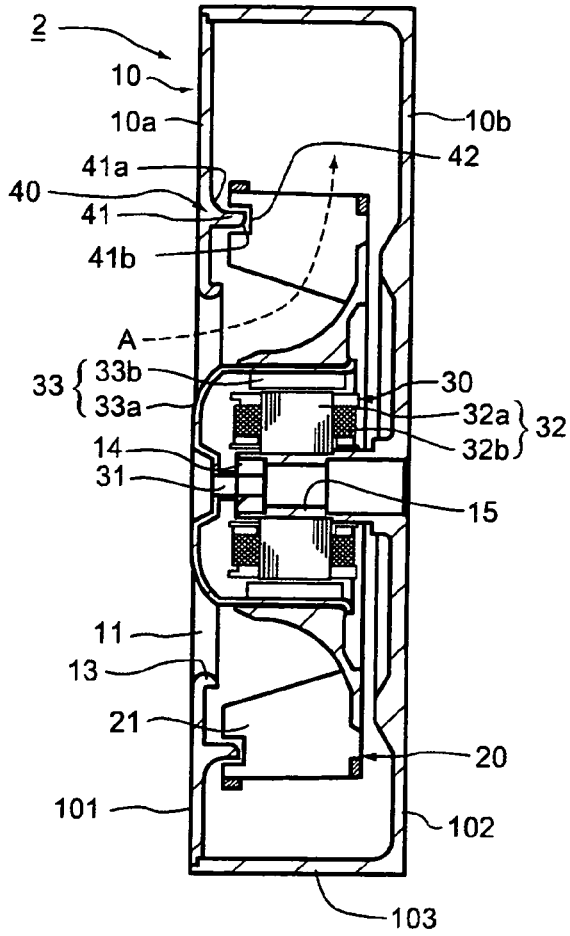
FIG. 1 is a sectional view of a centrifugal fan of an embodiment according to the present invention in a plane parallel to a rotating shaft.
Figure 2:
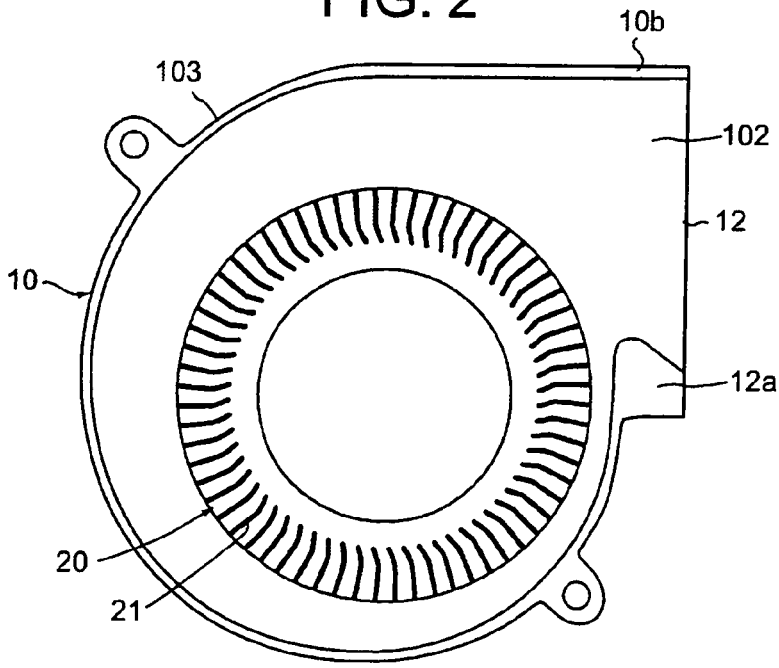
FIG. 2 is a front view of the centrifugal fan shown in FIG. 1 when a first casing is removed.
Figure 3A:
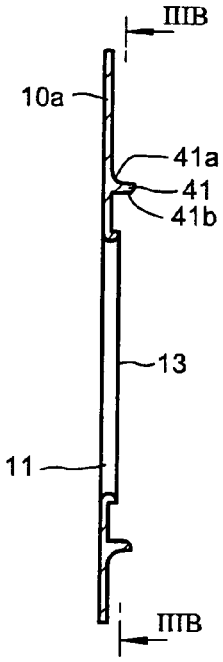
FIG. 3A is a sectional view of the first casing of the centrifugal fan shown in FIG. 1.
Figure 3B:
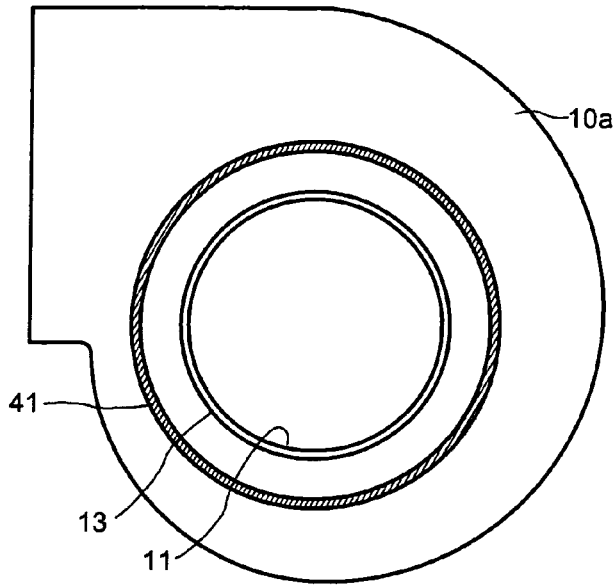
FIG. 3B is a sectional view of the first casing shown in FIG. 3A along a IIIB-IIIB line viewed from inside.
Figure 4:
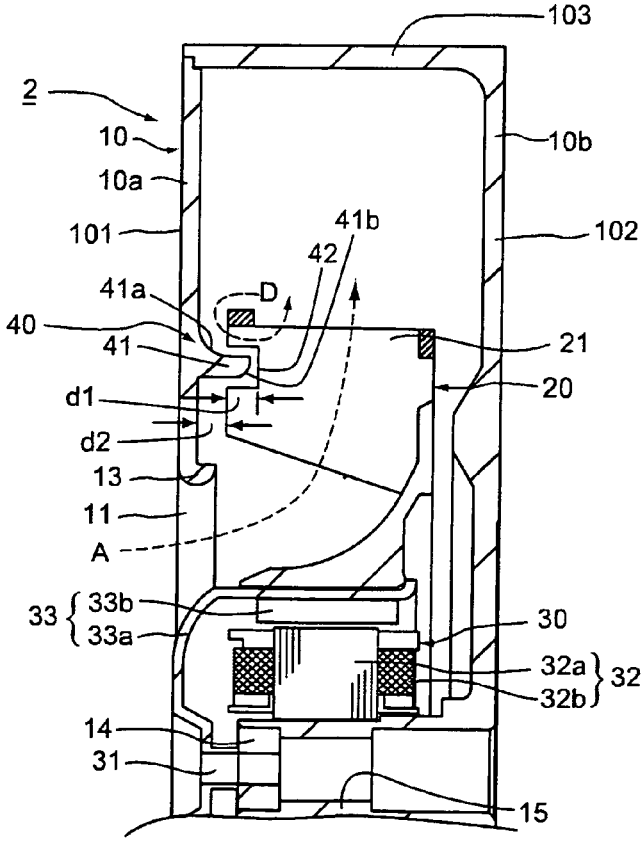
FIG. 4 is an enlarged sectional view of the upper half of the centrifugal fan shown in FIG. 1.

FIG. 1 is a sectional view of the centrifugal fan 2 of the embodiment in a plane parallel to a rotating shaft, FIG. 2 is a front view of the centrifugal fan 2 shown in FIG. 1 when a first casing is removed, FIG. 3A is a sectional view of the first casing of the centrifugal fan 2 shown in FIG. 1, FIG. 3B is a sectional view of the first casing shown in FIG. 3A along a IIIB-IIIB line viewed from inside, and FIG. 4 is an enlarged sectional view of the upper half of the centrifugal fan 2 shown in FIG. 1. Since the outward appearance and the generic construction at the inside of the centrifugal fan 2 of the embodiment are identical to that of the prior art, the same parts are described with the same reference numbers.

The centrifugal fan 2 of the embodiment is provided with a scroll casing 10 that has first and second flat base walls 101 and 102, a circumferential side wall 103 covering the circumferences of the base walls 101 and 102. The resin-made casing 10 consists of a first casing 10*a* and a second casing 10*b*. The first casing 10*a* constitutes the first base wall 101, and the second casing 10*b* constitutes the second base wall 102 and the circumferential side wall 103. An air inlet 11 that is opened in an axial direction is formed on a center portion of the first casing 10*a*, and an exhaust port 12 that is opened in a circumferential direction is formed on one position of the circumferential side wall 103 (see FIG. 2).

Inside the casing 10, an impeller 20 having many blades 21 along the outer region thereof is rotatably mounted. The inner circumferential surface of the casing 10 is formed like a scroll and the width of an airflow path, which is formed between the inner circumferential surface of the casing 10 and the outer circumference of the impeller 20, in the radial direction gradually increases from a nose 12*a* (see FIG. 2) of the exhaust port 12 as a starting point in the rotating direction of the impeller 20 (the clockwise direction in FIG. 2).

A motor 30 that drives to rotate the impeller 20 is fixed to a bearing box 15 that is formed on the center portion of the second base wall 102 of the second casing 10*b*. A rotating shaft 31 of the motor 30 is perpendicular to the base walls 101 and 102.

The rotating shaft 31 of the motor 30 is rotatably supported by bearings 14 arranged inside the bearing box 15. The motor 30 is an outer-rotor type DC brushless motor that consists of a stator 32 having a stator core 32*a* and coils 32*b* wound in slots of the stator core 32*a*, and a rotor 33 having a cup-shaped hub 33*a* fixed on the tip of the rotating shaft 31 and a permanent magnet 33*b* attached to the inner circumferential surface of the hub 33*a*. The stator 32 is fixed to the outer circumference of the bearing box 15. Further, the impeller 20 is fitted to the outer circumference of the hub 33*a* of the rotor 33.

A bell mouth 13 is formed along the inner circumference of the air inlet 11. The bell mouth 13 is formed by bending a tip whose thickness is the same as the other portion of the casing 10 inside.

During operation, the impeller 20 rotates in the clockwise direction in FIG. 2. As a result, the major portion of air taken in from the air inlet 11 is discharged to the periphery of the impeller 20 as regular airflow A by the centrifugal force as shown in FIG. 1 and FIG. 4. The air is collected by the inner circumferential surface of the casing 10, and is discharged from the exhaust port 12.

The centrifugal fan 2 of the embodiment is provided with an airflow correction mechanism 40 that forms smooth airflow when the impeller 20 rotates. The airflow correction mechanism 40 has an annular rib 41 that is formed on the inside surface of the first casing 10*a* so as to be jutted to the side of the second base wall 102 of the second casing 10*b* and to be concentric with the rotating shaft 31, and a recess portion 42 that is formed on every blade 21 of the impeller 20 so that the annular rib 41 is inserted therein with a predetermined gap. The annular rib 41 and the recess portion 42 are configured to change the direction of airflow from the scroll space outside the impeller 20 to the air inlet 11 back to a space between the blades 21 during operation.

That is, since the insertion of the annular rib 41 into the recess portion 42 forms a wall in the path directed to the air inlet 11 and produces airflow resistance, the airflow directed to the air inlet 11 returns back to the space between the blades 21 as shown by an arrow D in FIG. 4, which prevents generation of backflow and recycling flow. In addition, since the annular rib 41 is inserted into the recess portion 42 while keeping a noncontact condition, it does not disturb the rotation of the impeller 20.

Further, an outer bottom portion 41*a* of the annular rib 41 is formed to have a circular curve section so that the outer circumferential surface of the annular rib 41 is smoothly connected to the inside surface of the first casing 10*a* (the first base wall 101). As a result, the airflow passing through the space between the impeller 20 and the casing 10 is effectively redirected so as to merge with the regular flow A that is taken in from the air inlet 11 and flows in the radial direction.

Still further, inner tip portion 41*b* of the annular rib 41 is formed to have a circular curve section. This does not interrupt the regular airflow A along this portion during high air quantity operation.

As shown in FIG. 4, a depth d1 of the recess portion 42 formed on the blades 21 is larger than a gap d2 formed between the inside surface of the first casing 10*a* and the impeller 20 faced with each other. As a result of examinations to keep enough airflow resistance to prevent backflow by the airflow correction mechanism 40, it has been confirmed that enough airflow resistance can be obtained when the condition d1>d2 is satisfied.

Figure 5:
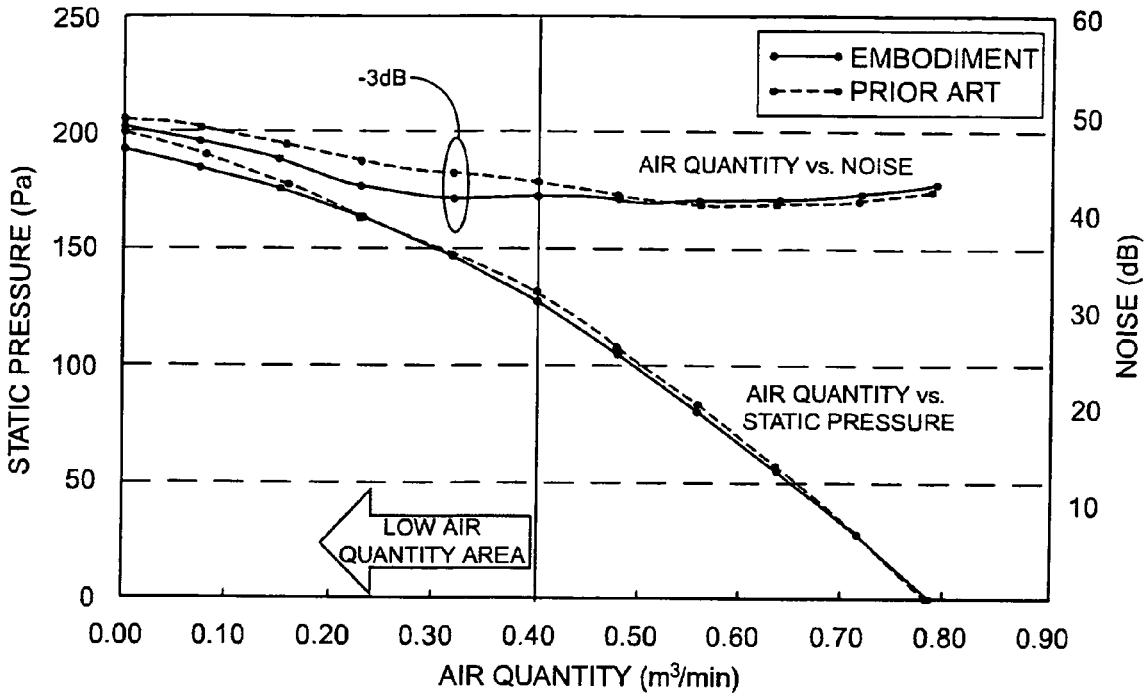
FIG. 5 is a graph showing the performance of the embodiment in comparison with that of the prior art.
Figure 6:
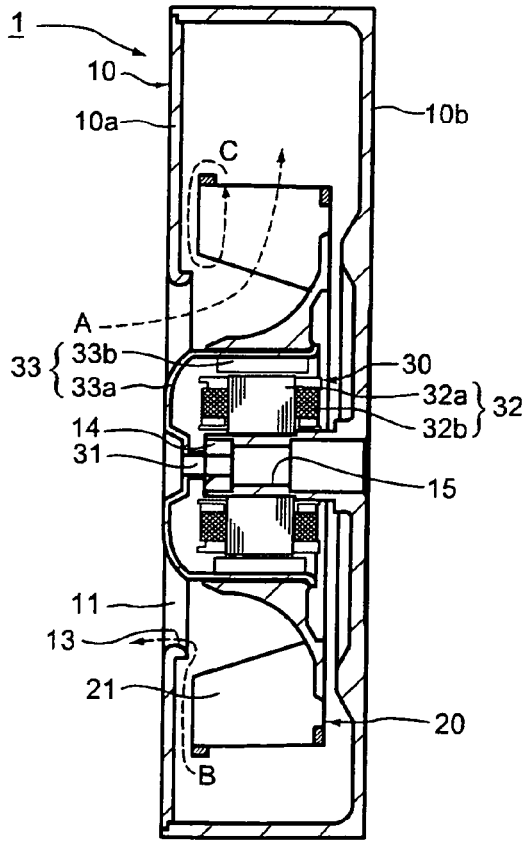
PRIOR ART FIG. 6
FIG. 6 is a sectional view of a conventional centrifugal fan in a plane parallel to a rotating shaft.
Figure 7:
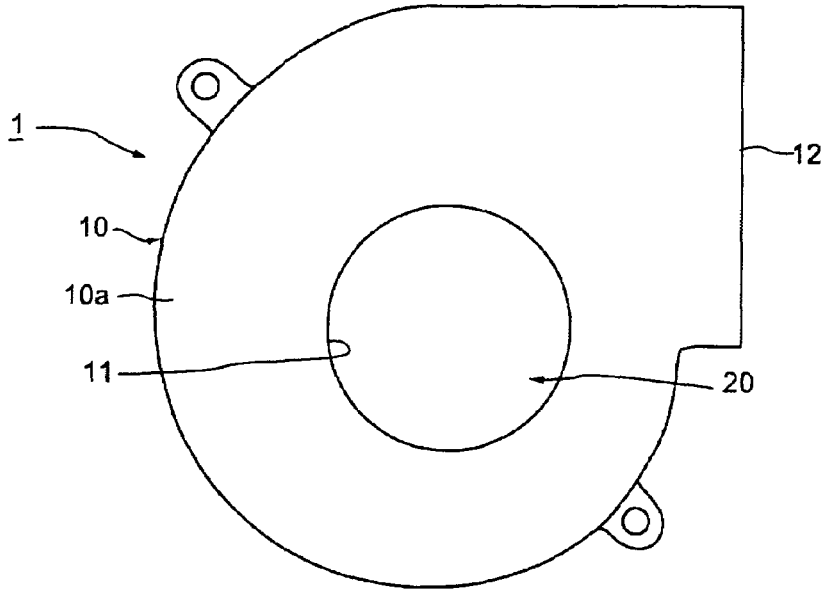
PRIOR ART FIG. 7
FIG. 7 is a front view of the centrifugal fan shown in FIG. 6 viewed from an air inlet.
Figure 8:
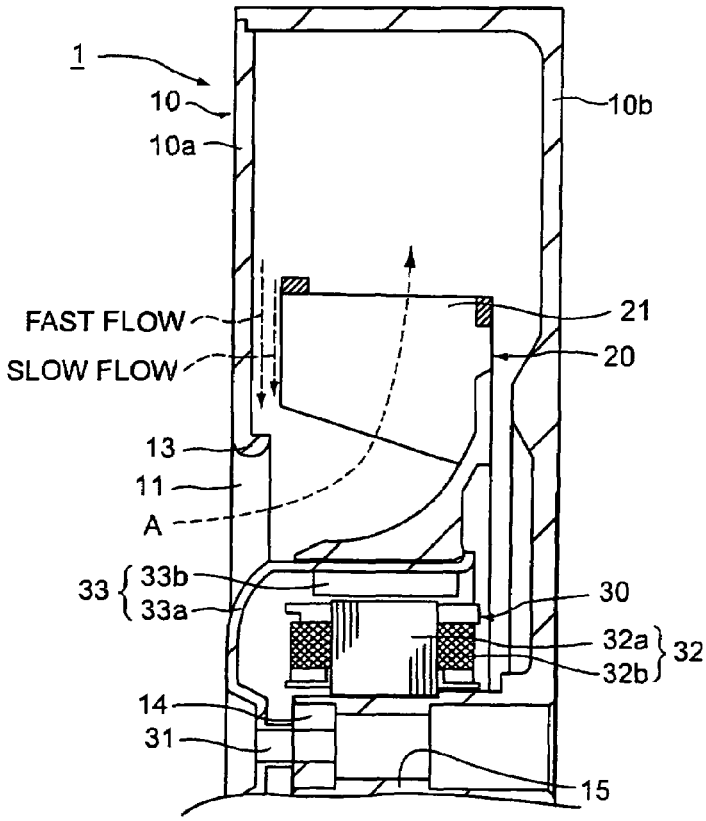
PRIOR ART FIG. 8
FIG. 8 is an enlarged sectional view of the upper half of the centrifugal fan shown in FIG. 6.

FIG. 5 is a graph showing the performance of the embodiment in comparison with that of the prior art shown in FIG. 6 through FIG. 8. In the graph, solid lines represent the embodiment and dotted lines represent the prior art. The horizontal axis of the graph shows air quantity, the left vertical axis shows static pressure, and the right vertical axis shows noise. The upper two lines represent relationship between air quantity and noise, and the lower two lines represent relationship between air quantity and static pressure. This graph shows that there are almost no difference in the static pressure (blowing performance) between the embodiment and the prior art and that the noise of the embodiment drops 3 dB at the maximum as compared with the prior art.

As described above, the construction of the embodiment can prevent from generating the backflow directed to the air inlet and the recycling flow even when the fan operates with low air quantity, which can prevent reduction of the blowing performance and generation of noise.

What is claimed is:

1. A centrifugal fan comprising:

a scroll casing that has first and second flat base walls, a circumferential side wall covering the circumferences of said base walls, an air inlet that is opened in an axial direction being formed on a center portion of said first base wall and an exhaust port that is opened in a circumferential direction being formed on one portion of said circumferential side wall;

a motor that is attached to a center portion of said second base wall at the inside of said casing so that a rotating shaft of the motor is perpendicular to said second base wall;

an impeller that is fixed to said rotating shaft, the impeller having many blades along the outer region thereof; and an airflow correction mechanism that forms smooth airflow when said impeller rotates, wherein said airflow correction mechanism has an annular rib that is formed on the inside surface of said first base wall so as to be jutted to the side of said second base wall and to be concentric with said rotating shaft, and a recess portion that is formed on every blade of said impeller so that said annular rib is inserted therein with a predetermined gap, said annular rib and said recess portion being configured to change the direction of airflow directed to said air inlet back to a space between said blades, and wherein said annular rib is substantially perpendicular to said first base wall and is at the outer region of said air inlet, an outer bottom portion of said annular rib having a circular curve section so that the outer circumferential surface of said annular rib is smoothly connected to the inside surface of said first base wall, and an inner tip portion of said annular rib having a circular curve section.

2. The centrifugal fan according to claim 1, wherein the depth of said recess portion is larger than a gap formed between the inside surface of said first base wall and said impeller that face each other.

* * * * *